United States Patent [19]

Sudderth et al.

[11] Patent Number: 4,642,924

[45] Date of Patent: Feb. 17, 1987

[54] EMBROIDERY HOOP

[75] Inventors: William H. Sudderth, Kernersville; Gary Vos, Oak Ridge, both of N.C.

[73] Assignee: Blue Bell, Inc., Greensboro, N.C.

[21] Appl. No.: 569,653

[22] Filed: Jan. 10, 1984

[51] Int. Cl.[4] ..... D05C 1/04; D06C 3/08

[52] U.S. Cl. ..... 38/102.2; 38/102.91; 112/103

[58] Field of Search ..... 38/102.2, 102.1, 102.91, 38/102.3-102.9; 160/380; 69/19, 19.1, 19.3; 112/103

[56] References Cited

U.S. PATENT DOCUMENTS

| | | | |
|---|---|---|---|
| 960,012 | 5/1910 | Heeley | 38/102.5 |
| 1,201,924 | 10/1916 | Berry | 112/103 |
| 3,818,620 | 6/1974 | Field et al. | 38/102.2 |
| 4,247,998 | 2/1981 | Foss | 38/102.2 |
| 4,422,250 | 12/1983 | Golan | 38/102.2 |
| 4,485,574 | 12/1984 | Bennetot | 38/102.2 |

FOREIGN PATENT DOCUMENTS

| | | | |
|---|---|---|---|
| 0085638 | 8/1983 | European Pat. Off. | 38/102.2 |
| 362592 | 7/1962 | Switzerland | 112/103 |

*Primary Examiner*—Werner H. Schroeder
*Assistant Examiner*—Andrew M. Falik
*Attorney, Agent, or Firm*—Charles R. Rhodes; Judith E. Garmon

[57] ABSTRACT

An embroidery hoop fixture for releasably retaining a fabric swatch between a base member having an opening with a beveled edge on which a fabric swatch is supported in cooperation with a pair of clamping sectors positioned on the base member and fabric swatch for releasably retaining the fabric swatch with the sectors forming a coincident opening with the base member opening. The sectors are provided with depending base member beveled lugs for cooperative releasable engagement with the base member beveled edge. The pair of sectors is yieldably connected together for releasable clamping engagement of the sectors to the base member by means of the depending lugs.

6 Claims, 10 Drawing Figures

EMBROIDERY HOOP

This present invention relates to an embroidery hoop which may be used industrially for supporting a fabric swatch in which stitched designs may be formed.

BACKGROUND AND OBJECTIVES OF THE PRESENT INVENTION

Embroidery hoops of various types have been employed for many years to embroider designs in fabrics in which a pair of circular hoops are nested one within the other to releasably clamp a fabric in a stretched condition to permit stitchery of various types and a multiplicity of patterns to be formed in the fabric.

Illustrative of various types of embroidery hoops are U.S. Pat. Nos. 643,069; 1,098,442; and 1,120,357, among others. The evolution of embroidery, embroidery sewing machines, designing and pattern making are described in *EMBROIDERY: SCHIFFLI & MULTI HEAD* by Coleman Schneider, copyrighted in 1978 by C. Schneider (Publisher), Box 762, Tenafly, N.J. 07670.

The utilization of fancy stitching and patterns or designs on patch pockets for jeans has been widely used and the utilization of an embroidery hoop for industrial use has been found highly advantageous for mass production. The use of hand supported embroidery hoops has not been found to be sufficiently durable or practical for industrial use particularly for mass production.

Therefore it is an objective of the present invention to provide a sturdy embroidery hoop for industrial use which may readily be used for mass production and repeated use with minimum down time and maintenance.

Another objective of the present invention is to provide a fixture in the form of an embroidery hoop for supporting a fabric swatch in which the swatch is securely maintained in position for machine stitching and rapid fabric swatch securement and release.

Another objective of the present invention is to provide a embroidery hoop fixture that may be readily mounted on a sewing machine for stitching in which a fabric swatch may readily be positioned to expose portions to be stitched or embroidered and in which the fixture may be rapidly separated by an operator to position a fabric to be stitched and remove it when completed to be replaced by another fabric swatch without difficulty.

Other objectives and many of the attendant advantages of ths embroidery hoop fixture will become more readily apparent to those skilled in the embroidery and sewing arts from a detailed description and accompanying claims in which modifications and variations are contemplated.

SUMMARY OF THE INVENTION

An embroidery hoop fixture in which a base circular member has a fabric swatch receiving opening with spaced inclined segments for cooperatively receiving a fabric swatch, and a cooperative fabric swatch articulated clamping member having sectors that are yieldably expanded and contracted with cooperatively depending lugs to engage the inclined segments on the base circular member releasably to clamp a fabric swatch in the fixture by displacement of the sectors toward and away from each other.

DETAILED DESCRIPTION OF THE PREFERRED EMBODIMENT OF THE INVENTION

Figure 1:
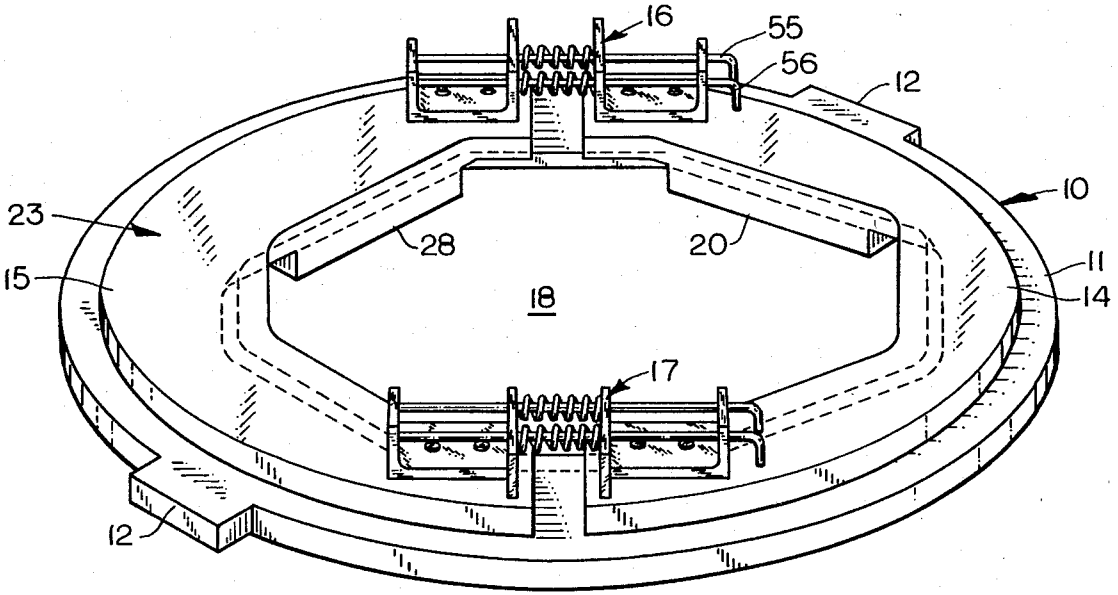
FIG. 1 is a top perspective view of an embroidery hoop fixture embodying the invention.
Figure 8:
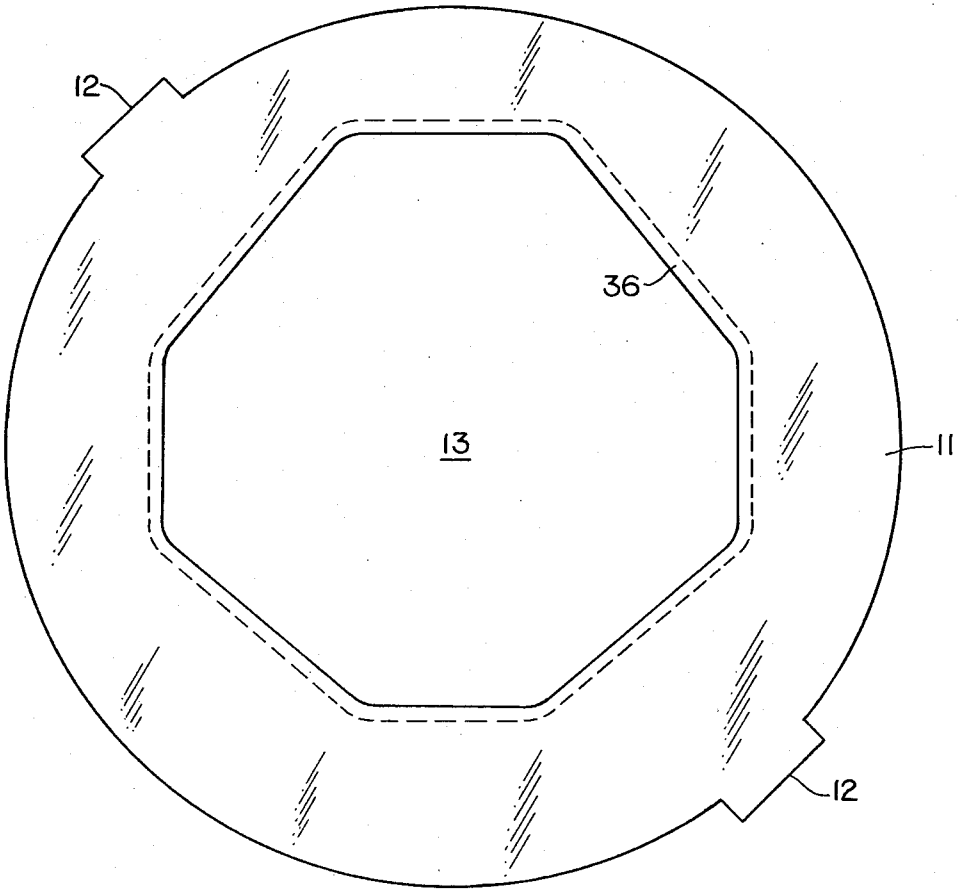
FIG. 8 is a top plan view of the mating base circular member of the embroidery hoop fixture.
Figure 10:
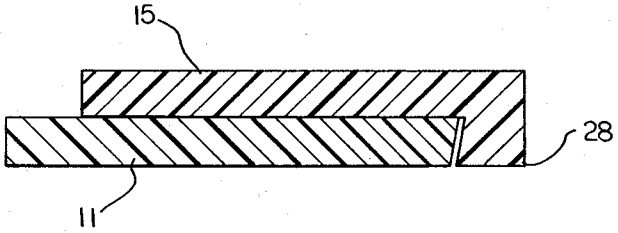
FIG. 10 is a sectional view taken across the side 28 in FIG. 1.

Referring to FIG. 1, there is illustrated an embroidery hoop fixture 10 embodying the present invention shown in the assembled condition in which a base circular member 11 is provided with outwardly projecting lugs 12 which are diametrically opposed to each other and is provided with an octagonally-shaped opening 13, as shown in FIG. 8. A pair of cooperatively related sectors 14 and 15 yieldably joined together by the yielding clamp members 16 and 17 form a cooperating octagonal opening formed by the sectors 14 and 15 coincident with the octagonally-shaped opening in the circular base member 11.

Figure 4:
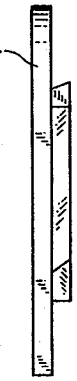
FIG. 4 is a left end view of FIG. 2.
Figure 2:
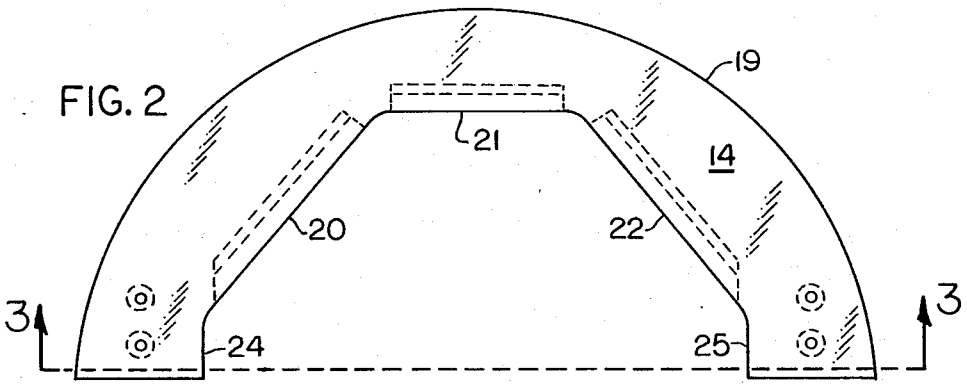
FIG. 2 is a top plan view of one clamp sector of the embroidery hoop fixture of FIG. 1.
Figure 3:
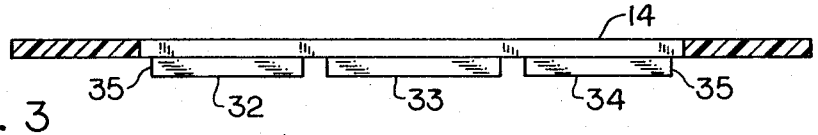
FIG. 3 is a transverse view of FIG. 2 taken along line 3—3 of FIG. 2.
Figure 5:
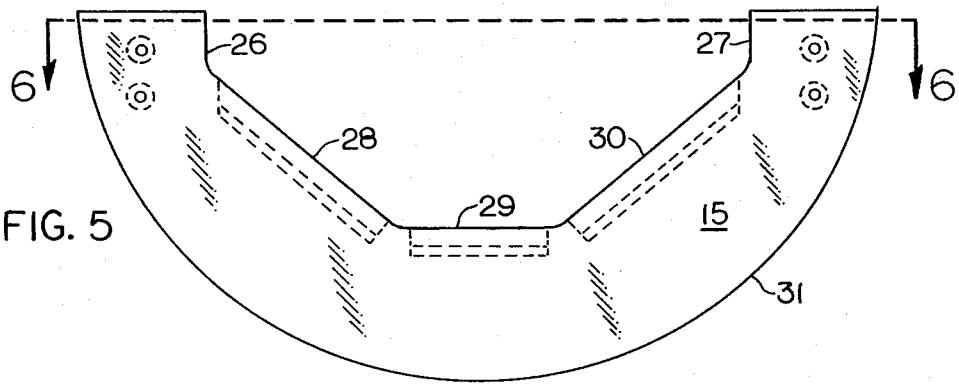
FIG. 5 is a top plan view of the other clamping sector of the fixture of FIG. 1.
Figure 7:
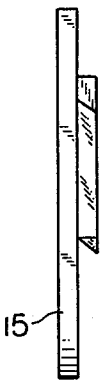
FIG. 7 is a left end view of FIG. 5.
Figure 6:
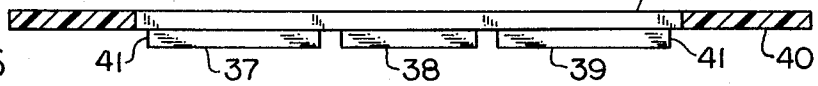
FIG. 6 is a transverse view of FIG. 5 taken along line 6—6 of FIG. 5.

Sector 14 as shown in FIGS. 2–4 has a substantially semi-circular outer periphery 19 with three full sides 20, 21 and 22 of the octagonally-shaped configuration of the assembled yieldable articulated clamping member 23 in which the foreshortened sides 24 and 25 form portions of the sides 26 and 27 in sector 15 of FIG. 5 which when added to sides 28, 29 and 30 in sector 15 form the octagonally-shaped opening 18 which will be coincident substantially with the octagonally-shaped opening 13 in base 11. Sector 15 is also provided with a substantially semi-circular periphery 31 having substantially the same curvature and diameter as sector 14.

Depending lugs 32, 33 and 34 are secured to the sides 20, 21 and 22 respectively of sector 14 with each of the lugs having a chamfered angle or beveled outer edge 35 for cooperatively clamping and being retained in the chamfered or beveled inner edge 36 in the circular base member 11 as shown by the dotted line in FIG. 8.

Similar depending locking lugs 37, 38 and 39 are secured to a bottom surface 40 of sector 15 in which the lugs 37, 38 and 39 are also provided with chamfered or beveled edges 41 for cooperative retention in the beveled or chamfered edge 36 of the base circular member 11.

The sectors 14 and 15, as stated above, are resiliently joined together by the members 16 and 17 as shown in FIG. 1 enabling the sectors 14 and 15 with their depending lugs to be disengaged from the beveled edge 36 of the base circular member 11.

Figure 9:
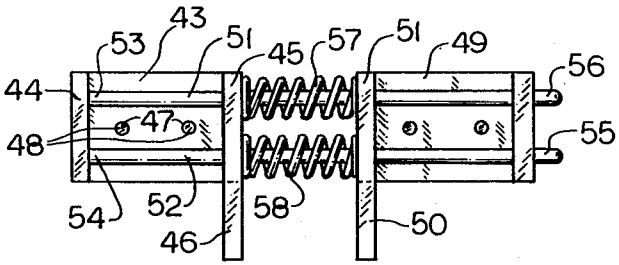
FIG. 9 is a top plan view of a hoop spring locking member in the extended position.

Each of the members 16 and 17 is shown in FIG. 9 and includes a U-shaped securing bracket 43 in which upwardly extending spaced-apart legs 44 and 45 are parallel to each other with leg 45 having a projecting finger engaging extension 46. A pair of threaded openings 47 in the U-shaped bracket 43 cooperatively receive bracket retaining screws 48 which extend through the sectors 14 and 15 for retaining the brackets 43 in position as shown in FIG. 1. U-shaped bracket 49 is similar to bracket 43 and is secured in the same manner as bracket 43 to the sectors 14 and 15 except that it is essentially a mirror image and is provided with a finger-engaging extension 50 on the leg 51 for cooperating with finger-engaging member 46. A pair of spring-supporting guide rods 51 and 52 are mounted and retained in the upstanding legs of the U-shaped brackets with the ends 53, 54 of each of the rods 51 and 52 being securely fastened to the upstanding leg 44 permitting the opposite leg ends 55 and 56, respectively, which are L-shaped to serve as limited stops when the encircling helical springs 57 and 58 which encircle rods 51 and 52 at their medial positions between brackets 43 and 49 are in the spring extended or relaxed position as shown in FIG. 9.

For disengaging the assembled sectors 23 from the base circular member 11, the finger engaging portions 46 and 50 of each of the releasable clamping members 16 and 17 are engaged to compress the helical springs 57 and 58 thereby disengaging the sector lugs from mating locking engagement with the beveled edge 36 thereby permitting disengagement or unlocking of the members from each other.

A fabric swatch may be positioned between the assembled sectors and the base member 11 across the openings 13 and 18 for releasable clamping by the depending lugs in sectors 14 and 15 in conjunction with the beveled edge 36 of base member 11 for releasable locking engagement therebetween upon positioning of the sectors 14 and 15 and extension or relaxation of helical springs 57 and 58 from a compressed position to an extended condition as shown in FIG. 1.

It has been found highly satisfactory to use lucite, plexiglass, other plastic materials, wood or metal for the circular base member and sectors including the depending lugs. The configuration of the openings 13 and 18 may vary depending upon the configuration of the fabric swatch to be embroidered or stitched. Other types of releasable clamping means may be utilized for the sectors to achieve the releasable locking engagement as will be readily apparent to one skilled in the art in place of that which is described and shown, and such variations are contemplated within the scope of the appended claims.

We claim:

1. An embroidery hoop comprising: a base member having an opening therein; a pair of sectors together forming an inner assembly; said inner assembly being releasably supported on said base member and having an opening substantially coincident with the opening in said base member; said base member further including an inwardly facing beveled edge at least in the portions thereof surrounding said opening; each of said sectors including at least one depending lug means for releasably engaging the perimeter of said opening in said base member; each of said lug means having a cooperating outwardly facing beveled edge for releasable locking engagement with said beveled edge in said base member; said pair of sectors being selectively movable between a first position whereby said inner assembly is engaged with said base member, and a second position wherein said inner assembly is released from said base member; and connecting means for retaining said sectors together and activating said sectors between said first and second positions.

2. An embroidery hoop fixture as claimed in claim 1, each of said sector retaining means having a pair of U-shaped brackets and being secured to retain such sectors in diametrical opposed positions, each sector retaining means having a pair of U-shaped brackets, a pair of rods extending and supported by said U-shaped brackets forming an assembly, each of said brackets being supported and retained on a sector adjacent to each other, spring members on said rods resiliently separating said U-shaped brackets in said assembly, and means for manually displacing said pair of brackets in each assembly on said brackets whereby said sectors are urged inwardly to engage and be releasably locked to said base member.

3. An embroidery hoop fixture as claimed in claim 2, said sector retaining means having finger-engaging means for displacing said sectors toward each other for positioning said sector beveled lugs into mating releasable locking engagement with said base member beveled edge and releasing said lugs having beveled edges from engagement with said base member beveled edge.

4. An embroidery hoop fixture as claimed in claim 3, said base member and said pair of sectors being constructed of plastic.

5. An embroidery hoop fixture as claimed in claim 1, said sector retaining means having spring members to resiliently urge said sector retained lugs into engagement with said base member beveled edge.

6. An embroidery hoop fixture as claimed in claim 5, said base member opening and said opening in said pair of sectors having a polygonal pair of openings that are substantially coincident with each other.

* * * * *